US006592415B2

(12) United States Patent
Berthiaume

(10) Patent No.: US 6,592,415 B2
(45) Date of Patent: Jul. 15, 2003

(54) VEHICLE HAVING IMPROVED FUEL, LUBRICATION AND AIR INTAKE SYSTEMS

(75) Inventor: Yves Berthiaume, Palm Bay, FL (US)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 10/174,940

(22) Filed: Jun. 20, 2002

(65) Prior Publication Data

US 2002/0160670 A1 Oct. 31, 2002

Related U.S. Application Data

(62) Division of application No. 09/935,771, filed on Aug. 24, 2001.

(60) Provisional application No. 60/229,340, filed on Sep. 1, 2000, and provisional application No. 60/227,530, filed on Aug. 24, 2000.

(51) Int. Cl.[7] ..... B63H 21/38

(52) U.S. Cl. ..... 440/88 A

(58) Field of Search ..... 440/88, 88 A; 123/184.21

(56) References Cited

U.S. PATENT DOCUMENTS 5,340,344 A * 8/1994 Mineo et al. ..... 114/55.53
5,558,549 A * 9/1996 Nakase et al. ..... 114/55.57

FOREIGN PATENT DOCUMENTS

JP 63-215494 * 9/1988
WO 00/03138 1/2000

OTHER PUBLICATIONS

Bombardier "Sea–Doo", Parts Catalog 2000, RX DI 5646/5656, p. C1 to C5, Dec. 1999.
Bombardier "Sea–Doo", Parts Catalog 1999, GS 5846/5847, p. C2, Dec. 1998.
Bombardier "Sea–Doo", Parts Catalog 1988, 5801, p. B10 and B11.

* cited by examiner

*Primary Examiner*—Sherman Basinger
(74) *Attorney, Agent, or Firm*—Pillsbury Winthrop LLP

(57) ABSTRACT

A vehicle, including watercraft and personal watercraft, includes a hull, an engine system and a propulsion system. The engine system comprises an internal combustion engine and an air intake for receiving air to be mixed with fuel supplied to the engine. The propulsion system connects to the engine and propels the watercraft along a surface of a body of water using power from the engine. The watercraft can include a quick connect air/water separator, or air box. A fuel system is provided that has a fuel supply line and a fuel return line which are connected with a bypass line. For evacuating fuel from the supply line and the return line, the bypass line contains a valve which can be actuated to allow fuel to flow into the fuel reservoir. A lubrication system is provided that includes a filler neck comprising an oil/air separator which allows a mixture of oil and air to be separated and the oil to be returned to the oil reservoir.

13 Claims, 14 Drawing Sheets

VEHICLE HAVING IMPROVED FUEL, LUBRICATION AND AIR INTAKE SYSTEMS

This is a Divisional Application of U.S. application Ser. No. 09/935,771 filed Aug. 24, 2001, which claims priority from U.S. Provisional Application No. 60/227,530, filed Aug. 24, 2000, and also claims priority from U.S. Provisional Application No. 60/229,340, which was filed Sep. 1, 2000, the entirety of each is hereby incorporated by reference.

FIELD OF THE INVENTION

The present invention relates generally to a vehicle, such as a watercraft. More specifically, the invention relates to a watercraft including personal watercraft, having improved fuel, lubrication and air intake systems.

BACKGROUND AND SUMMARY OF THE INVENTION

Vehicles including those of the type known as personal watercraft, are commonly powered by internal combustion engines, which are arranged to drive a propulsion device for propelling the vehicle. In personal watercraft, internal combustion engines are generally positioned within their hulls and these engines are generally arranged to drive a water propulsion device for propelling the craft.

As is well known, it is undesirable to allow water to enter the intake system of such an engine, as the water may mix with air within the combustion chamber(s) and cause the engine to stall or stop. Water can remove lubrication from the cylinder wall, causing piston seizure, and water in the crankcase may lead to corrosion of the crankcase, and needle bearings. Generally, watercraft have a sealed hull assembly, including a hull and a deck, with vent openings that enable ambient air to enter the hull assembly for use by the engine during combustion. Air conduits transport the air from the vent openings to vent hoses. The vent hoses open generally downwardly to direct the air to the bottom of the watercraft so that at least some of the water present in the air will drop out of the air to the bottom of the hull and flow to the bottom of a bilge for drainage. The air within the hull assembly is drawn through an airbox, which is connected to the engine.

Conventional airboxes communicate with the air compressor by using a hose that slides over an outlet of the airbox. Typically, the hose is attached to the outlet of the air box with a clamp which is clamped to the outside of the hose. The use of hoses and clamps to connect the airbox and the throttle body requires additional assembly steps which raise assembly cost and time of the watercraft. Likewise, maintenance, repair and lubrication may be more difficult.

Consequently, there exists a need in the art for a simpler and more cost-effective way of connecting an air/water separator to the air compressor.

To achieve this need, a watercraft comprising a hull, an engine system, a propulsion system, and an air/water separator is provided. The engine system has an internal combustion engine and an air intake for supplying air to the engine. The engine system communicates with the fuel supply. The propulsion system is connected to the engine and propels the watercraft along a surface of a body of water using power from the engine. The air/water separator comprises a container enclosing an interior space. The container has an inlet port and an outlet port. The inlet port enables ambient air to enter the container and the air/water separator comprises structure that is constructed and arranged to separate water suspended in the air from the air as the air passes through the container. The outlet port is in fluid communication with the air intake of the engine system so as to enable ambient air to be drawn into the air intake through the inlet port, the interior space and the outlet port. A conduit, which could include a throttle body, has a first end connected to the air intake of the engine system and an opposite end disposed within the outlet port of the air/water separator. The opposite end of the conduit is secured in sealed relation within the outlet port solely by a cooperation between the opposite end of the conduit and the outlet port which occurs upon movement of said air/water separator into its installed position. This cooperation may occur as a result of a friction fit between the outlet port and conduit opposite end, a snap-fit between the outlet port and conduit opposite end, a snap or friction fit between other structures on the air/water separator and structures on the conduit or structure associated therewith. The advantage is that no additional fasteners are required to make the connection because the connection occurs upon movement of the air/water separator into its installed position.

Internal combustion engines of watercraft require lubrication, both of the engine crankcase, and of other associated parts. The engines generally have oil supplied thereto via oil supply lines which are connected between an oil reservoir and the engine. More specifically, oil may be directly delivered to the crankcase to lubricate the pistons and likewise may be delivered to an air compressor for lubrication of that device. In some engine configurations, oil may be returned to the oil reservoir by an oil return line. Occasionally, the oil being returned may have air entrained therein, which is returned directly to the oil reservoir. This can create problems of high pressure and/or emulsion/bubbles in the oil reservoir. Preferably, the oil could be recovered and reused to further lubricate the engine without also delivering the entrained air to the oil reservoir.

Consequently, there exists a need in the art for an oil/air separator to separate the oil and the air from the oil/air mixture so that the separated oil may be returned to the oil reservoir and the separated air may be returned to the engine or vented to the atmosphere.

To meet this need, a watercraft comprising a hull, a fuel supply, an engine system, a propulsion system, an oil reservoir, an oil supply line, an oil pump, an oil/air return line, and a filler neck is provided. The engine system has an internal combustion engine and an air intake for supplying air to the engine. The engine system communicates with the fuel supply. The engine generates power by combusting a mixture comprising air supplied from the air intake and fuel from the fuel supply. The propulsion system is connected to the engine and propels the watercraft along a surface of a body of water using power from the engine. The oil reservoir contains a supply of oil to be supplied to the engine system for lubrication thereof. The oil supply line communicates with the oil reservoir and the engine system to enable oil to flow to the engine system. The oil pump is disposed in fluid communication with the oil supply line and pumps the oil from the oil reservoir to the engine system through the oil supply line. An oil/air return line communicates with the engine system and the oil reservoir. A filler neck has a filling opening in communication with the oil reservoir and further includes an oil/air separator. The oil/air separator has an inlet port in communication with the oil/air return line, and an outlet port communicating with the oil reservoir. The inlet port enables a mixture of oil and air from the engine system to enter the oil/air separator. The oil/air separator further includes structure to separate air entrained in the oil from the oil as the oil passes through the oil/air separator to allow the separated oil to be returned to the oil reservoir via the oil outlet port while the air is vented to the atmosphere or the throttle body.

Over a period of use, the internal combustion engine of the watercraft will require maintenance. Prior to performing maintenance activities, it is common practice to drain the fuel from the various fuel system components. Of particular importance are the fuel supply line, which connects the fuel tank with the fuel regulator to supply fuel from the fuel tank thereto, and the fuel return line, which connects the fuel regulator to the fuel tank to return excess fuel to the fuel tank.

Conventional methods of draining the fuel lines detach one fuel line from the fuel regulator, such as the fuel supply line. However, since the fuel between the fuel pump and the fuel regulator is maintained at a high pressure, fuel may be expelled under pressure from the detached end of the fuel supply line. This is problematic in watercraft because the hull assembly is watertight and there is no drainage for such fuel if it is expelled into the hull assembly. Moreover, it is preferable to avoid the requirement of providing a receptacle for the drained fuel, to avoid release into the environment. Thus, it is desirable to provide a mechanism by which the fuel may be drained into the fuel reservoir, which is already adapted to the purpose of fuel storage.

Consequently, there exists a need in the art for an improved fuel line arrangement, wherein fuel is precluded from flowing into the environment when it is drained from the fuel line.

To achieve this need, a vehicle comprising an engine system, a propulsion system, a fuel regulator, a fuel supply, a fuel return line, a bypass line and a valve is provided. The engine system comprises an internal combustion engine, an air intake for supplying air to the engine, and a fuel intake communicating with the fuel supply for supplying fuel to the engine. The engine is constructed and arranged to generate power by combusting a mixture of air drawn through the air intake and fuel drawn through the fuel intake from the fuel supply. The propulsion system is connected to the engine and propels the vehicle using power from the engine. The fuel regulator regulates fuel delivery to the fuel intake. The fuel supply line communicates with the fuel regulator to supply fuel from the fuel reservoir to the fuel regulator. The fuel return line returns excess fuel to the fuel reservoir from the fuel regulator. The bypass line communicates between the fuel supply line and the fuel return line and bypasses the fuel regulator. The valve can allow fuel flow through the bypass line. The valve is moveable between a closed position and an open position. In the closed position, the valve prevents fuel flow through the bypass line. In the open position, the valve allows fuel flow through the bypass line so as to allow fuel pressures in the fuel supply line and the fuel return line to equalize and to allow fuel to drain from the fuel supply line into the fuel reservoir.

This aspect of the invention may be practiced on vehicles other than watercraft, including but not limited to, motorcycles, automobiles, snowmobiles, and all-terrain vehicles.

Other aspects, features and advantages of the present invention will become apparent from the following detailed description, the accompanying drawings, and the appended claims.

DETAILED DESCRIPTION OF THE PRESENT INVENTION

In FIGS. 1–14, there is shown a watercraft, generally indicated at 10, according to the principles of the present invention. In the exemplary embodiment, the watercraft 10 is in the form of a personal watercraft that is constructed and arranged for traveling along a surface of a body of water. The watercraft 10 comprises a hull 12 for buoyantly supporting the watercraft 10 on the surface of the body of water. The hull 12 is typically molded from fiberglass material and partially lined internally with buoyant foam material.

Figure 1:
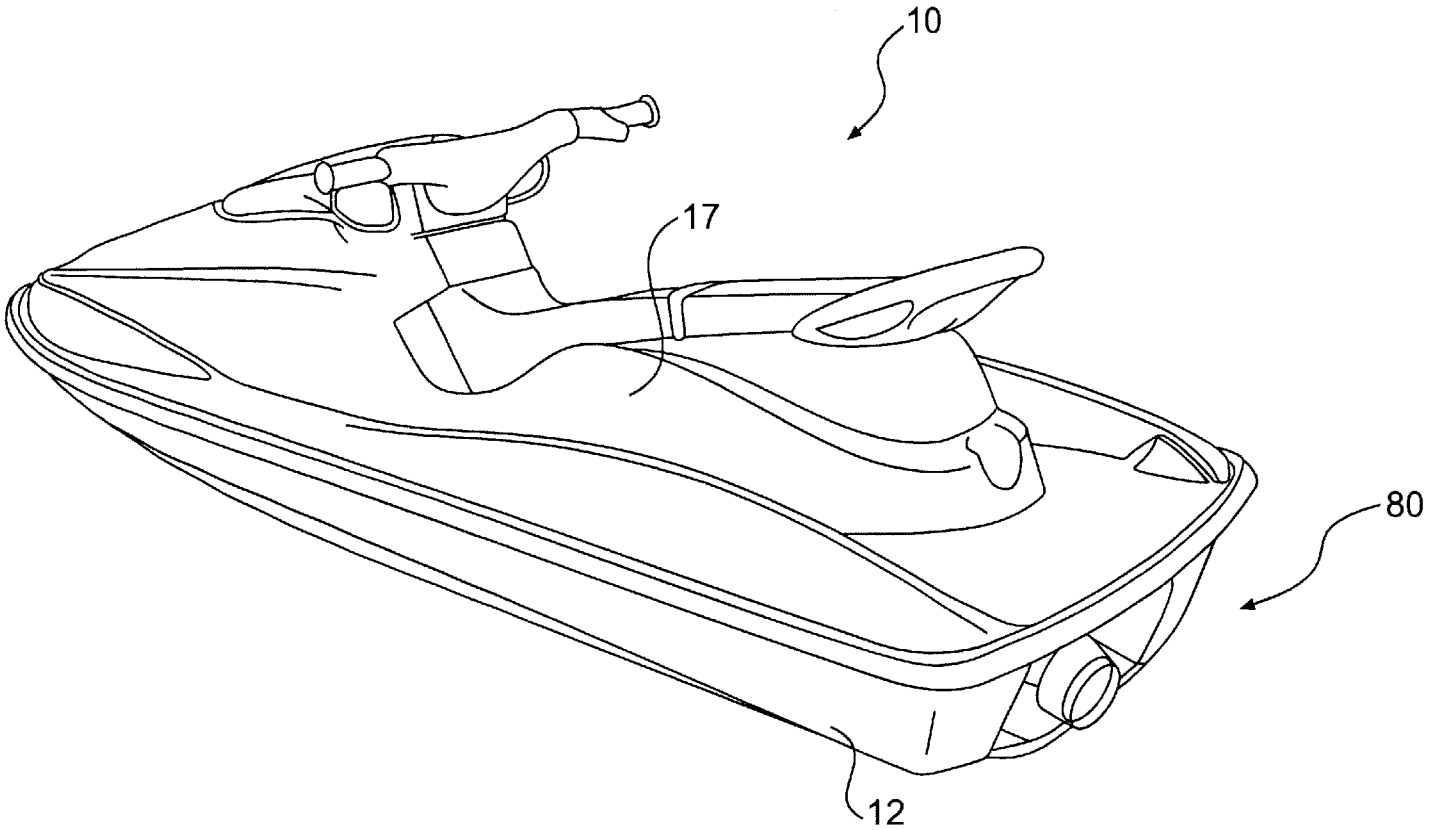
FIG. 1 is a perspective view of a watercraft for traveling along a surface of a body of water.
Figure 2:
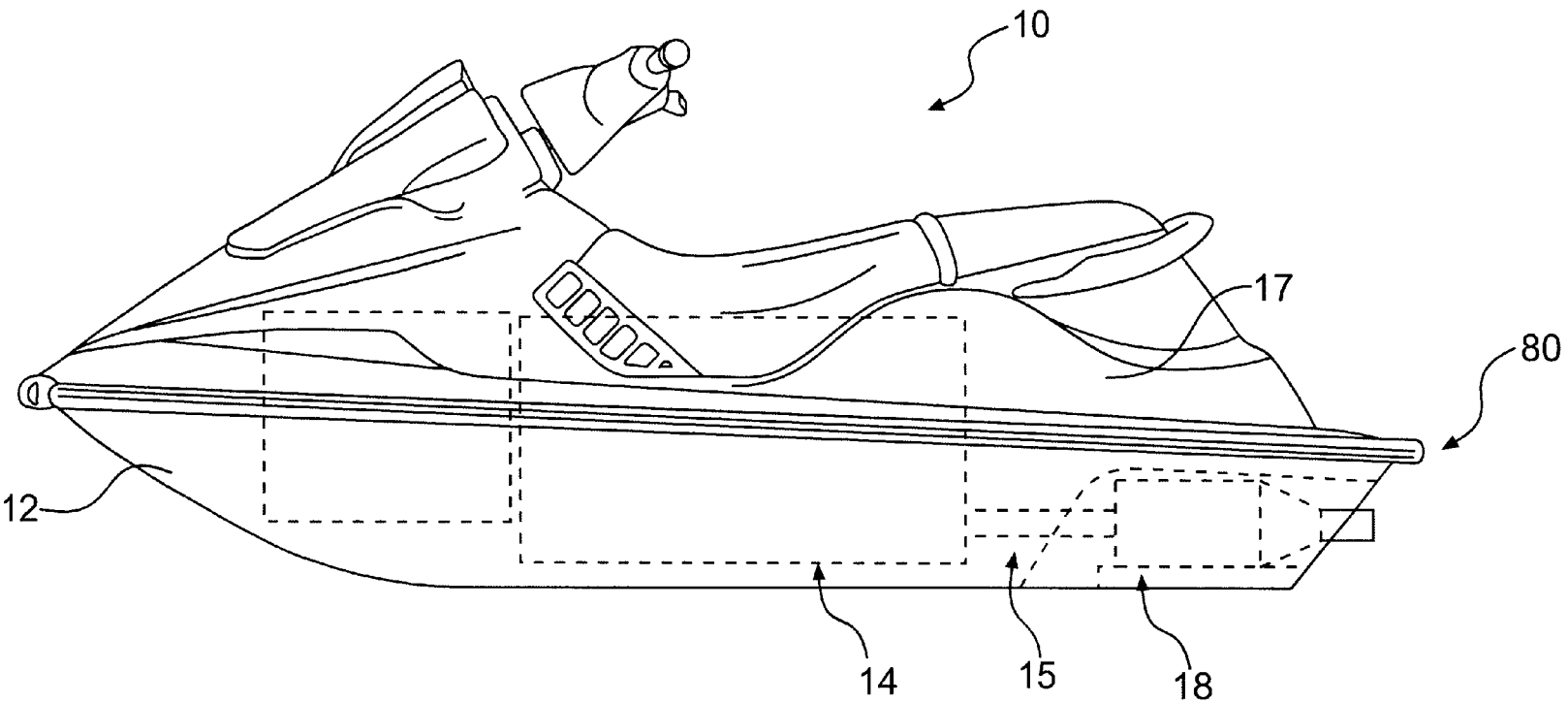
FIG. 2 is a side view of FIG. 1 showing internal components of the watercraft in phantom.
Figure 3:
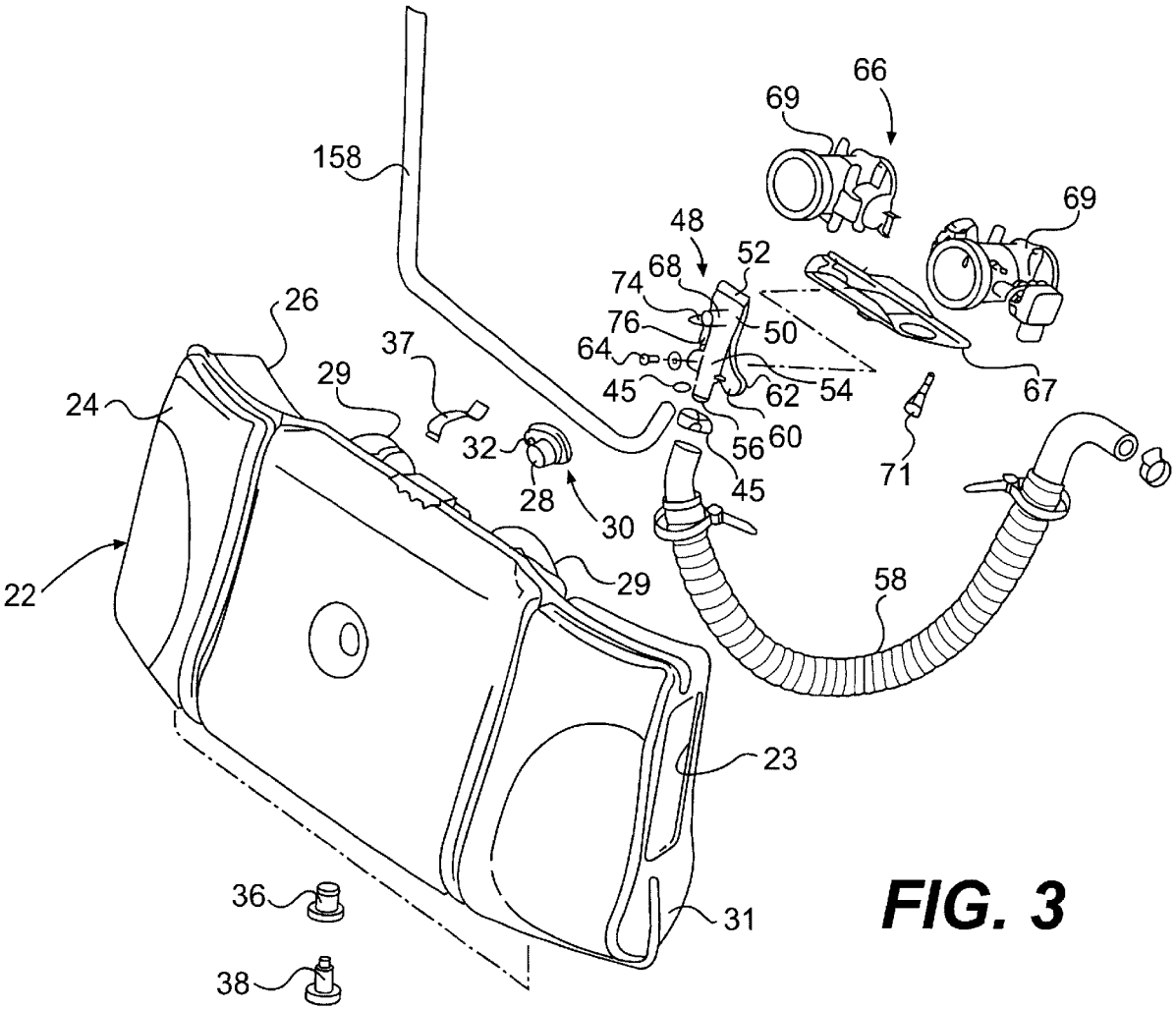
FIG. 3 is an exploded view showing an air/water separator constructed in accordance with the principles of the present invention.

An internal combustion engine, generally shown at 14 in FIGS. 2 and 3, is carried by and within a cavity formed by a deck 17 and the hull 12. As is well-known in the art, the engine 14 includes a crankcase 13 (FIG. 10) that forms a crankcase chamber (not shown) in which a crankshaft is rotatably journaled. A plurality of reciprocating pistons are connected to the crank shaft. The reciprocating motion of the pistons is translated into rotary motion of the crankshaft in a well-known manner. Specifically, the pistons reciprocate within a plurality of cylinders through a four or two stroke combustion cycle wherein a mixture of air and fuel in a four-stroke engine, or air, fuel and oil in a two-stroke engine, are combusted sequentially within the cylinders to drive the pistons for affecting rotational movement of the crankshaft. The engine 14 has an air intake 16 for receiving air to be mixed with the fuel supplied to the engine 14. The engine 14 may be of any construction.

A propulsion system, generally shown at 18 in FIG. 2, is connected to the crankshaft of the engine 14 in the hull's stern portion, generally shown at 80. The propulsion system 18 typically includes a propelling structure, such as a propeller or impeller, connected to one end of a driveshaft 15 with the other end of the driveshaft 15 coupled to the crank shaft so that powered rotation of the crank shaft rotates the propelling structure via the driveshaft 15. The propelling structure is constructed and arranged to displace water during rotation thereof so as to propel the watercraft 10 along the surface of the body of water. The propulsion system 18 may be centrally positioned within the hull 12 and may have any construction and its specific design is not vital to the present invention, though it will commonly be of the water jet type.

As is well-known in the art, the hull 12 has a plurality of vent openings that enable ambient air to enter the hull 12 for use by the engine 14 during combustion. Vent hoses open generally downwardly to direct the air to the bottom of the hull 12 so that at least some of the water present in the air will drop out of the air to the bottom of the hull 12 and flow to the bottom of a bilge pump for drainage, for example, through bailers.

Referring now more particularly to FIGS. 3–9, an air/water separator according to the present invention, generally shown at 22, is mounted in the hull 12 on the port side of the engine 14. The air/water separator 22 accepts air from the hull cavity for use by the engine. The air/water separator or container 22 preferably includes separate sections 24, 26 secured together in any known manner to enclose an interior space. The container 22 has an outwardly facing grommet receiving opening 29 (shown in FIG. 9), which receives a grommet 30. The grommet 30 defines an outlet port 28 therein that enables ambient air to exit the container 22. The outlet port 28 provides separated air from the air/water separator to an air compressor 33 (shown in FIG. 12) for use in the engine 14 during fuel injection.

Note that although the present invention is described and depicted as pertaining to a two stroke engine 14 having an air compressor 33, any appropriate engine configuration may be employed. For example, a four-stroke engine may be employed and may additionally be provided with a turbocharger or supercharger if desired. For purposes of explanation, the term "engine" or "engine system" is used herein to indicate any engine system including associated components such as an air compressor, turbocharger, supercharger and other components understood by one skilled in the art.

Air is provided to the engine directly from the air/water separator to a pair of throttle bodies 69 (shown in FIGS. 3 and 9) via a pair of annular projecting outlets 29. The grommet 30 also defines an inlet port 32, which is in fluid communication with the lubrication system via an air hose 158 through air intake adapter 48. The inlet port 32 accepts an air/oil mixture, which is actually air with possible trace amounts of oil, from an air/oil separator 130, which will be discussed in further detail below, or from an engine exhaust valve (not shown).

Figure 9:
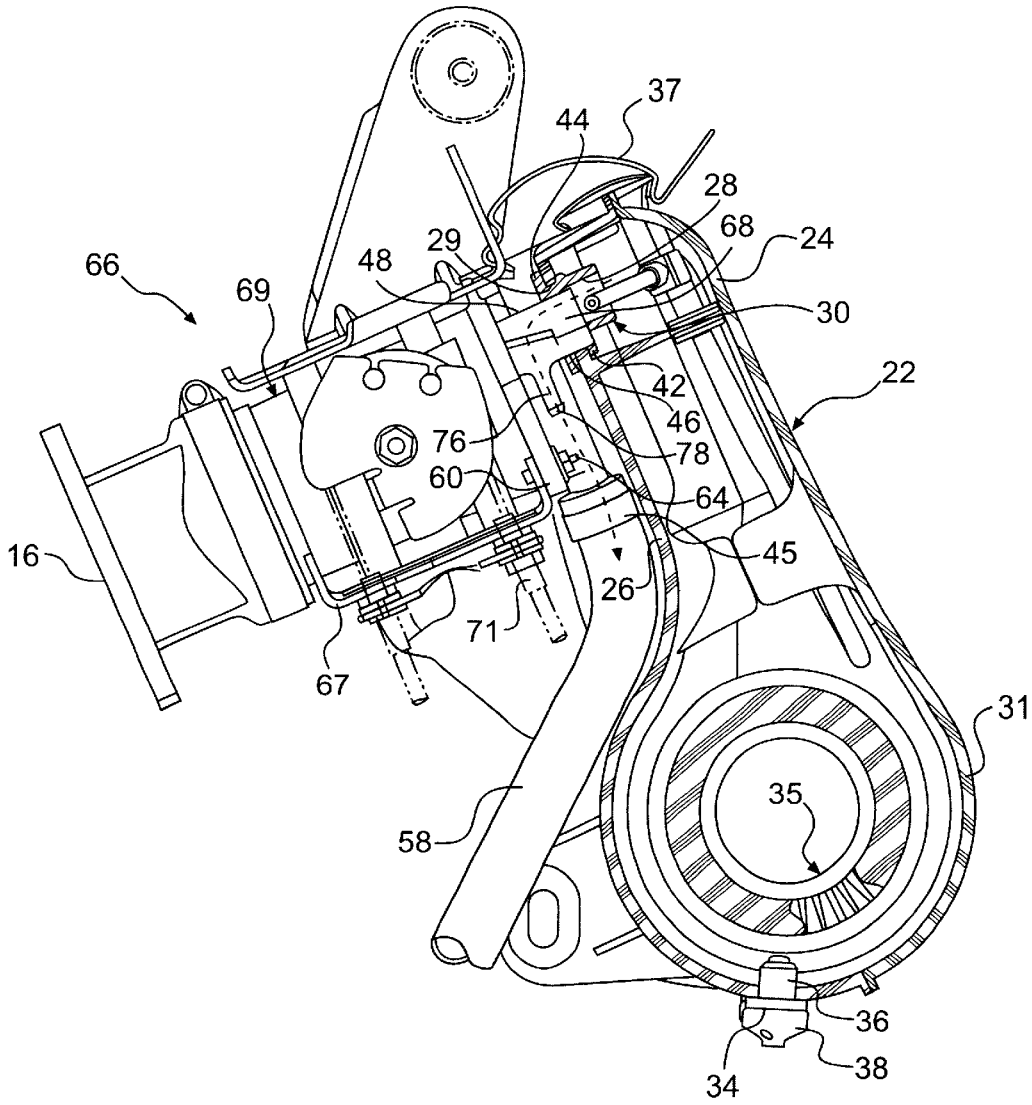
FIG. 9 is a partial cross sectional view of the air/water separator of FIG. 3 to more clearly show the interaction between the air intake adapter, grommet and the container.

As best shown in FIGS. 3 and 9, the container 22 is preferably molded from plastic to have an enlarged portion 31. A filter 35, which may also be used as a flame arrestor, is mounted in this portion. As the engine 14 draws the ambient air through the interior of the container 22 via the intake ports 23, the ambient air passes through the filter 35 so that the filter 35 tends to separate any water, and any other particles suspended in the air, from the air. Over time, the separated water in the filter 35 flows downwardly to the bottom portion of the container 22 by the force of gravity. Although a filter 35 is preferred because it will also filter debris from the air, the air/water separator may be provided by other structural arrangements, such as tortuous paths disclosed in commonly owned U.S. Provisional Patent Application of Bourret, Ser. No. 60/224,355, filed Aug. 11, 2000, the entirety of which is hereby incorporated into the present application by reference.

The bottom portion of the container 22 preferably includes an aperture 34 therein, which enables the water flowing to the bottom of the container 22 to flow out of the container 22. A sealing structure 36 may be inserted into the aperture 34. A check valve 38 extends through each aperture 34 so to permit water to drain from the container 22 therethrough, but to prevent water from entering the container 22 through the aperture 34. The sealing structure 36 prevents the ingress of water between the check valve 38 and the edge of the aperture 34.

It is contemplated that the aperture 34 may be linked to a negative pressure source (vacuum), such as a bilge pump.

The container 22 may be of any construction known in the art and may be made from other suitable materials, such as rubber, plastic, plasticized rubber or the like.

As is best seen in FIG. 9, the rubber grommet 30 is disposed within the grommet opening 29 formed in the container 22. The grommet 30 includes an inner lip 42 and an outer lip 44, respectively. The inner lip 42 is spaced from the outer lip 44 so to form a groove 46 therebetween. Preferably, the grommet 30 can be secured within the grommet opening 29 by a snap or press fit, wherein the inner lip 42 elastically deforms for insertion within the perimeter of the inlet port 28, the groove 46 engages the outer perimeter edge of the grommet opening 29 and the outer lip 44 engages a marginal surface area of the container 22 surrounding the grommet opening 29 to secure the grommet 30 therein.

Figure 4:
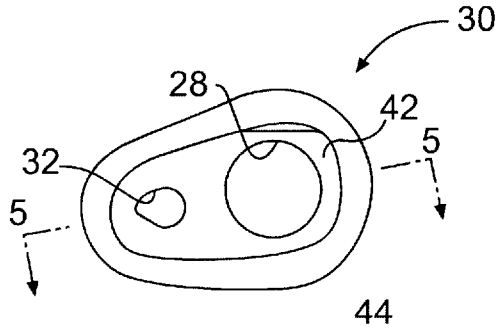
FIG. 4 is a top sectional view of a grommet of the air/water separator shown in FIG. 3.
Figure 5:
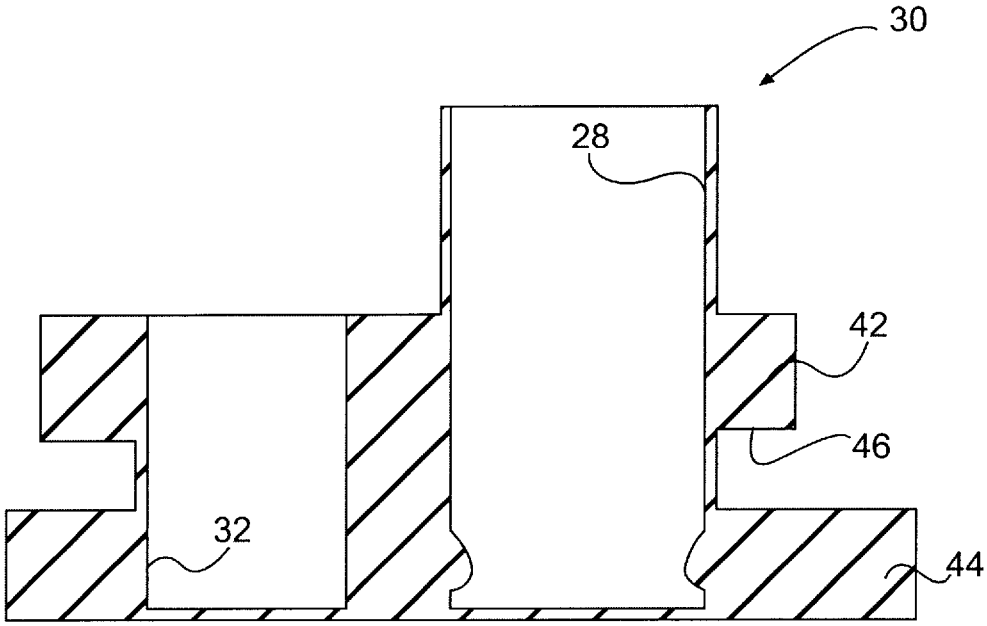
FIG. 5 is a cross sectional view of the grommet taken through the line 5—5 in FIG. 4.
Figure 6:
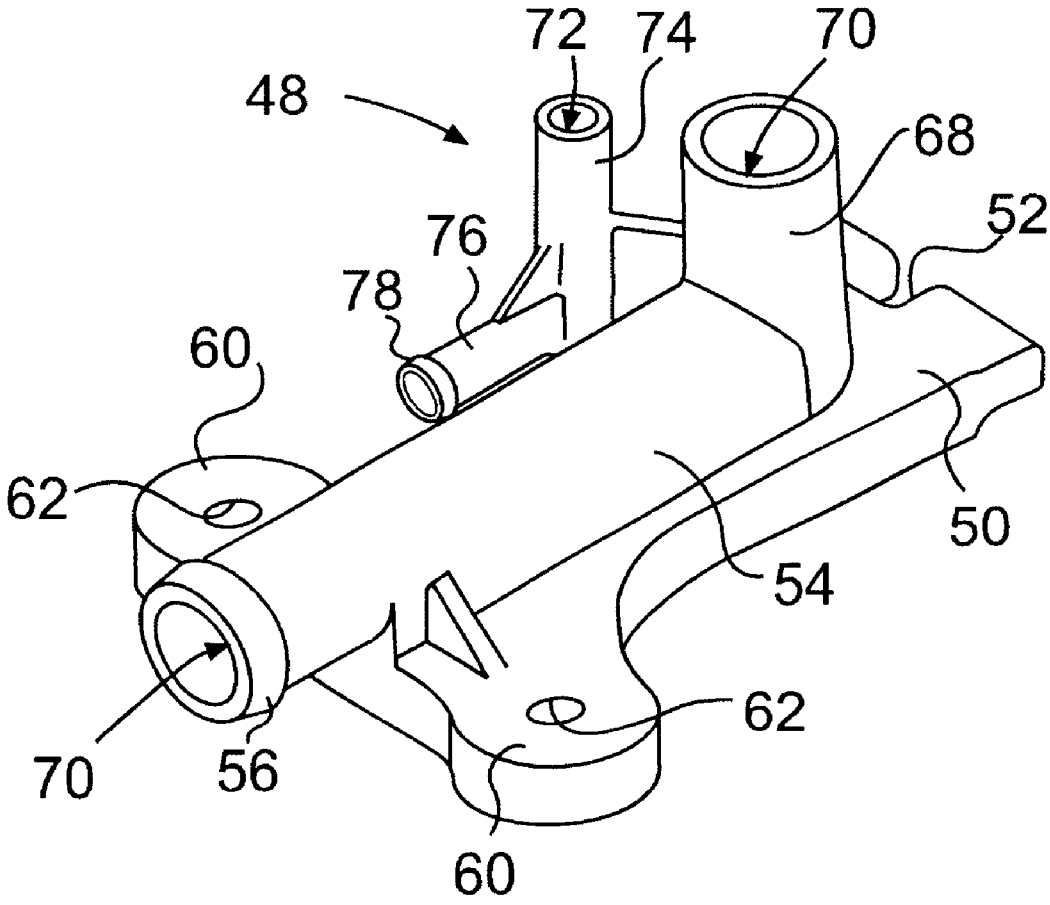
FIG. 6 is a perspective view of an air intake adapter of the air/water separator of FIG. 3 shown looking from the top thereof and one end thereof.
Figure 7:
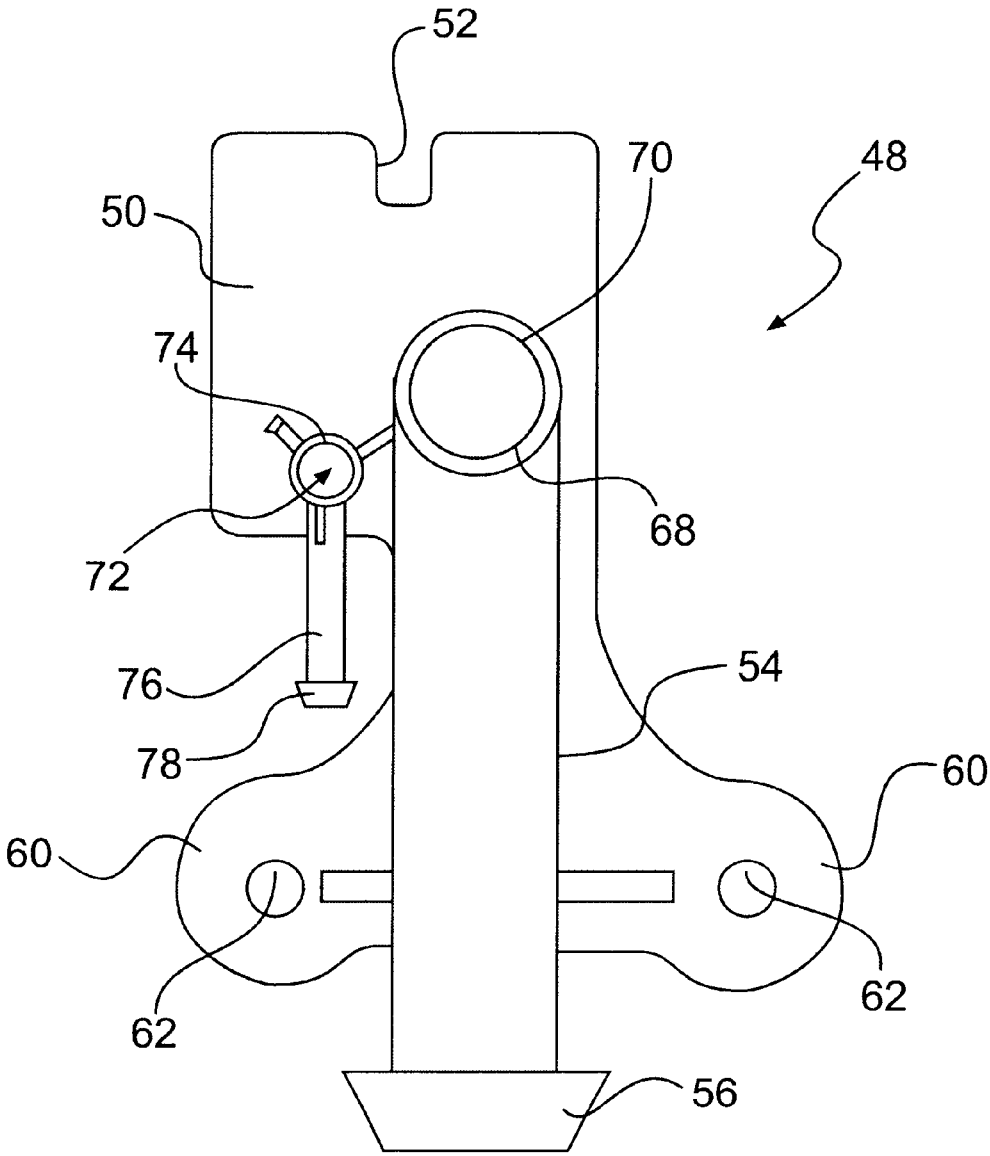
FIG. 7 is a front view of an air intake adapter shown in FIG. 6.
Figure 8:
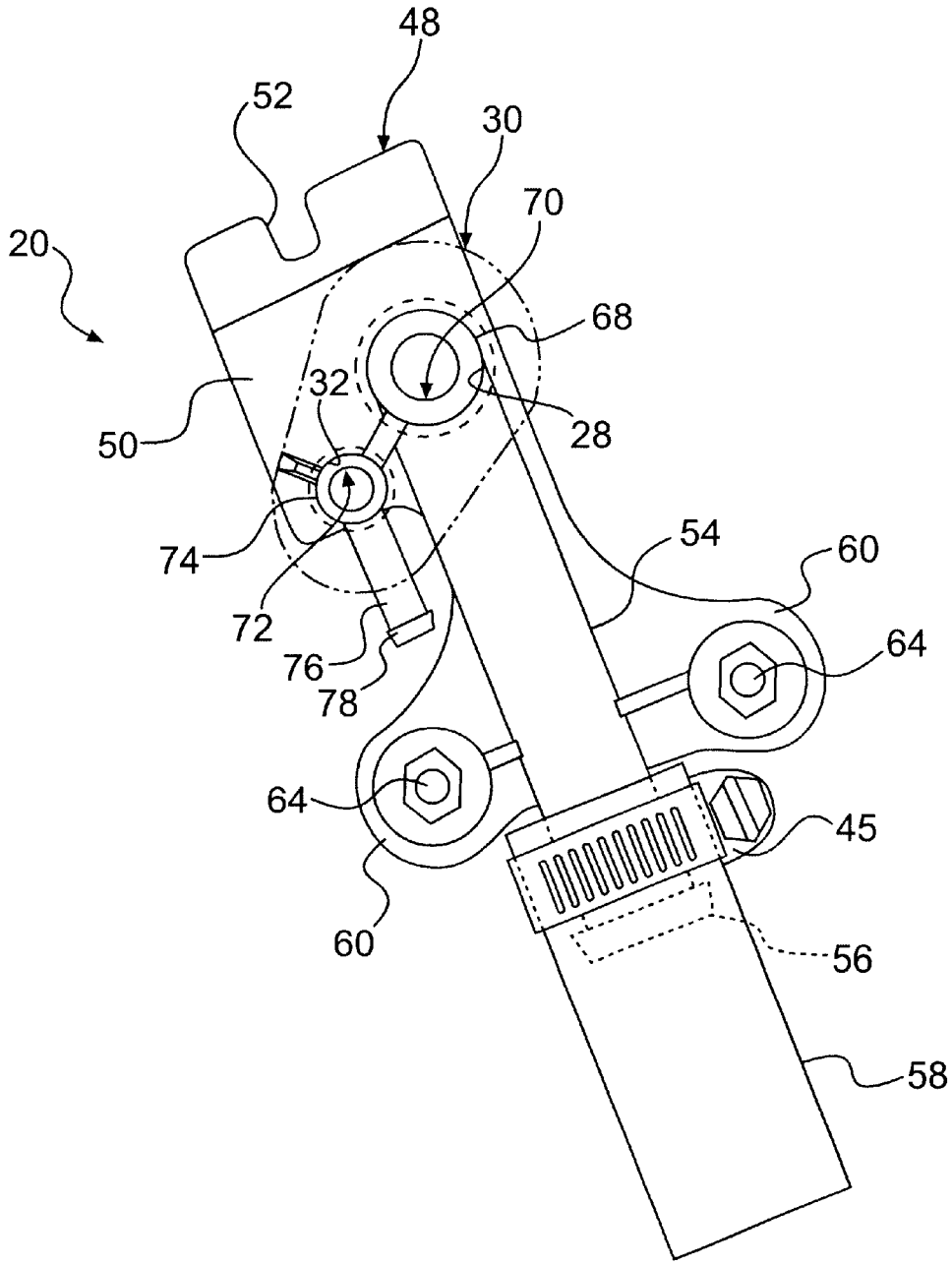
FIG. 8 is a front view of the air/water separator shown in FIG. 3 with the air intake adapter shown in solid and the grommet shown in phantom to more clearly show their structure and interaction.

As best shown in FIGS. 3–5, a pair of openings are formed in the grommet 30 to define the outlet and inlet ports 28, 32, respectively. The grommet 30 is preferably made from an elastic material. The outlet port 28 and the inlet port 32 extend through the grommet 30. The outlet port 28 has a larger diameter than the inlet port 32 and both the outlet and inlet ports 28, 32 are flared at one end thereof to receive a substantially rigid air intake adapter, generally indicated at 48.

As best shown in FIGS. 3 and 6–9, the air intake adapter 48 is configured to be releasably secured within the outlet and inlet ports 28, 32 in sealing relation therewith and communicating relation thereto. The adapter 48 includes a main body portion 50 having a centrally disposed notch 52 therein. An outlet conduit portion 54 having a straight tubular configuration is disposed on one side (the right side in FIG. 7) of the main body portion 50 and is integrally formed therewith. The outlet portion 54 has a frusto-conical end 56 configured to receive an air hose 58. The air hose 58 is removably connected between the flared end edge 56 and the air compressor 33 and may be secured by friction or with a clamp 45.

A mounting flange 60 extends outwardly from opposite sides of the main body portion 50. As best shown in FIGS. 3 and 6–8, the mounting flanges 60 have openings 62 formed therein, which are configured to receive fasteners 64 therethrough for mounting the adapter 48 to a throttle body assembly 66 of the engine 14. As best shown in FIGS. 3 and 9, the throttle body assembly 66 includes a mounting plate 67 for mounting the pair of throttle bodies 69. The pair of throttle bodies 69 regulate air flow into the engine 14. A plurality of fasteners 71, such as bolts, securely mounts the throttle bodies 69 to the mounting plate 67. The throttle bodies 69 include throttle body structure, which is not the novel feature of the present invention. Therefore, a description of the same is not provided for the sake of brevity. Further, a clip 37 may be provided for securing the air/water separator 20 to the throttle body assembly 66.

An outlet projecting portion 68 is integrally formed with the outlet portion 54 at a substantially right angle thereto. The outlet projecting portion 68 and the outlet portion 54 constitute an outlet conduit 70 for incoming air to pass therethrough. The outlet projecting portion 68 is releasably secured within the outlet port 28 and by the force of friction between itself and the perimeter of the outlet port 28. Insertion of the projecting portion 68 causes elastic deformation of the perimeter of the outlet port 28, which in turn, produces the force of friction that releasably secures the outlet engaging portion 68 within the outlet port 28.

An inlet conduit 72 for allowing incoming air (and possibly some entrained oil) from the oil/air separator 130 or an exhaust valve (not shown) to flow to the container 22 is disposed in adjacent spaced relation to the outlet conduit 70. The inlet conduit 72 preferably has a smaller transverse cross section than the outlet conduit 70. The inlet conduit 72 includes an inlet projecting portion 74 and an inlet portion 76.

The inlet projecting portion 74 is integrally formed with the inlet portion 76 at a substantially right angle thereto. The inlet projecting portion 74 is releasably secured within the inlet port 32. The inlet projecting portion 74 is held in place by the force of friction between itself and the perimeter of the inlet port 32. Insertion of the inlet projecting portion 74 within the inlet port 32 causes elastic deformation of the perimeter of the inlet port 32, which in turn, produces the force of friction that secures the inlet projecting portion 74 within the inlet port 32. Preferably, the inlet projecting portion 74 is longer than the outlet projecting portion 68 and projects away from the interior wall so that any oil contained in the air entering the container 22 falls to a platform disposed between the throttle bodies and is sucked into the throttle bodies.

It is contemplated that the grommet 30 may be integrally formed with the container 22 so that the outlet and inlet ports 28, 32 are formed in the container 22. Likewise, the outlet and inlet projecting portions 68, 74 could be configured to elastically deform within the perimeter of the outlet and inlet ports 28, 32, respectively, to produce the force of friction needed to releasably secure the conduit 48 to the container 22. It is also contemplated that container 22 may be provided with inlet and outlet projecting portions, instead of inlet and outlet ports 32,28, that would be releasably secured to inlet and outlet ports formed in the air intake adapter 48.

The inlet portion 76 has a frusto-conical end 78 configured to receive an air hose 158. The air hose 158 is removably connected between the inlet portion 76 and the lubrication system so as to receive air from the lubrication portion of the air compressor 33. Specifically, air from the exhaust valve and air/oil separator 136 is received by the inlet portion 76. While the air/oil separator will have removed most of the oil from the air, there may still be some residue. It is this residue which the inlet projecting portion 74 is designed to carry away from the container wall 22. The small amount of oil that enters the container 22 does not adversely affect the operation of the engine and can be pulled into the air system to be consumed in the combustion process.

Preferably, the grommet 30 is inserted into the grommet opening 29 via a snap fit sealing relation to define the outlet and inlet ports 28, 32 in the container 22. As discussed above, the adapter 48 is secured to the throttle body assembly 66 of the engine 14 by fasteners 64 which extend through the openings 62 of the flanges 60. The air/water separator 22, containing the grommet 30 within the grommet opening 29, is placed into the hull 12, adjacent and supported by the engine 14. The air/water separator 22 is maneuvered such that the grommet 30 engages the adapter 48 in sealing cooperative fit relation, thereby securing the air/water separator to the throttle body assembly. It may be preferable for the cooperative fit relation between the grommet 30 and the adapter 48 to be a friction fit, however, it may also be a snap fit, press fit or other interlocking relation. The use of a cooperative fit allows the air/water separator 22 to be connected to the adapter without the use of any clamps or other fasteners, thereby saving assembly steps.

More particularly, in securing the grommet 30 about the adapter 48, the outlet and inlet ports 28, 32 are aligned with and engaged around the outlet and inlet projecting portions 68, 72, respectively, and secured in sealed relation therein solely by a cooperative fit relation. Manual force is sufficient to secure the outlet and inlet ports 28, 32 around the outlet and inlet projecting portions 68, 72, respectively in sealed relation, however, any other type of securing force may be used. External air is precluded from entering the outlet and inlet ports 28, 32 due to their sealed relationship with the outlet and inlet projecting portions 68, 72.

Manual force is sufficient to separate the outlet and inlet projecting portions 68, 72 from their sealed relation with the outlet and inlet ports 28, 32, respectively.

Figure 10:
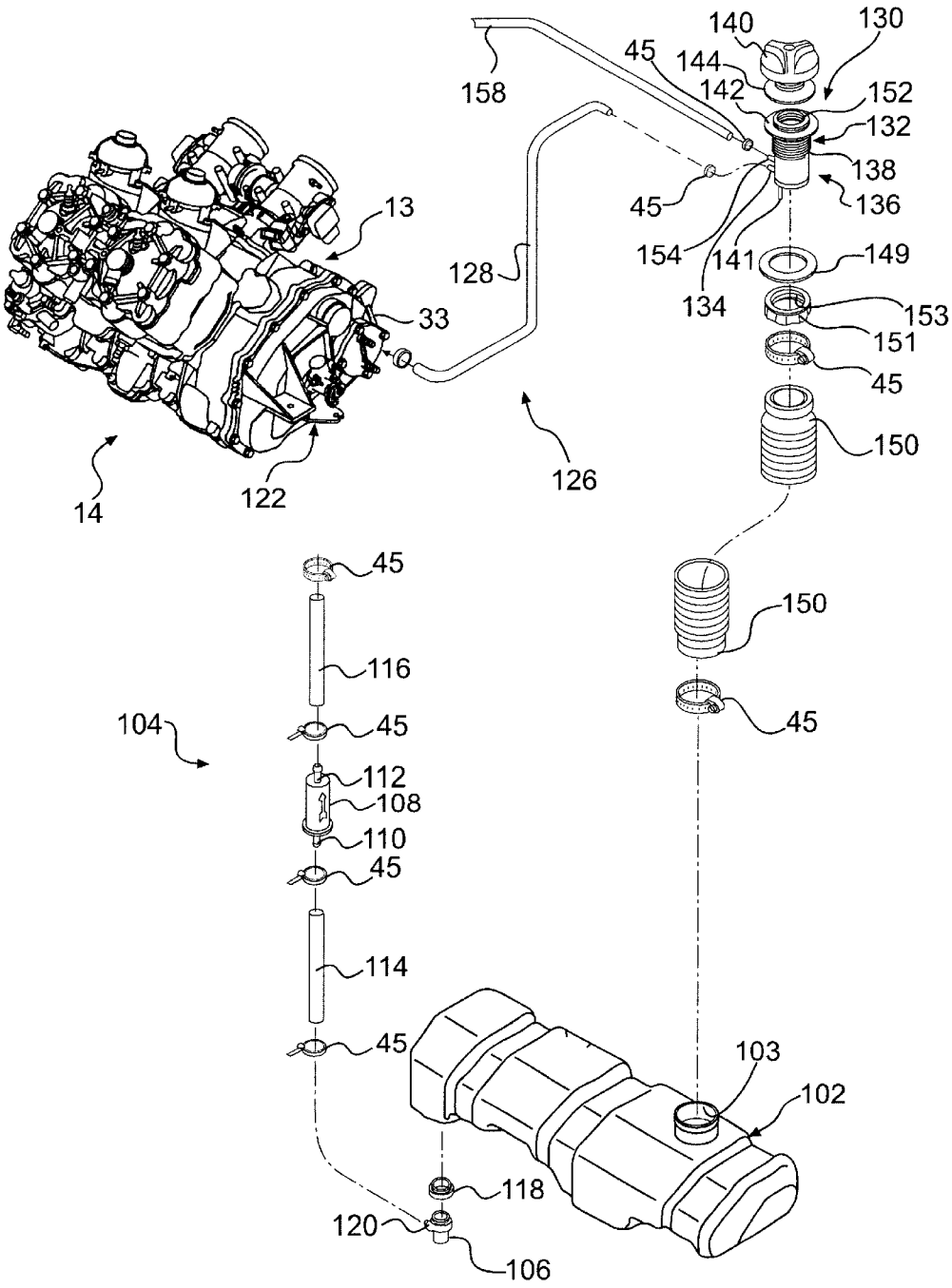
FIG. 10 is a perspective view of an engine lubrication system incorporating an oil/air separator constructed in accordance with the principles of the present invention.
Figure 11:
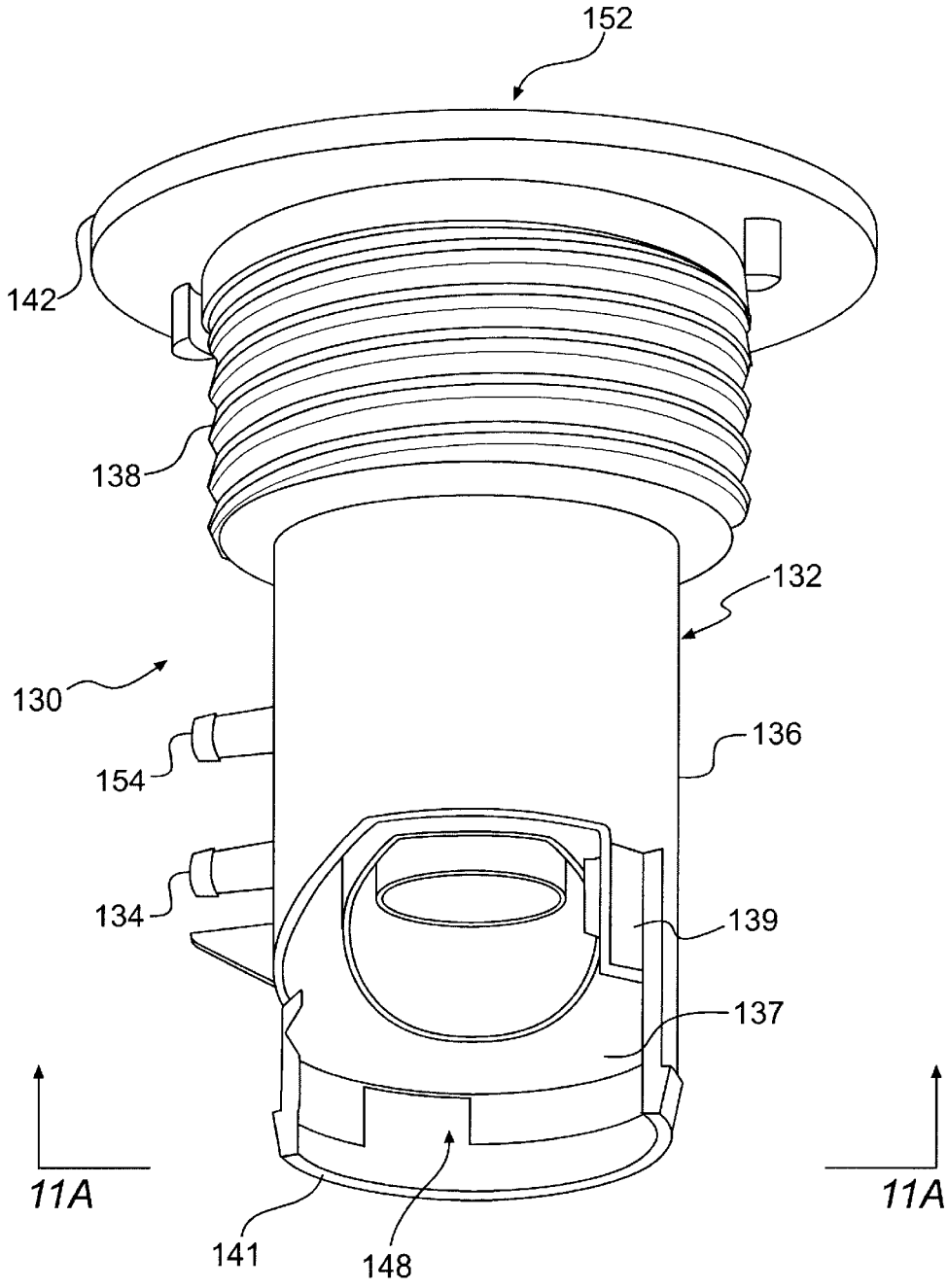
FIG. 11 is a front perspective view of the oil/air separator shown in FIG. 10.
Figure 11A:
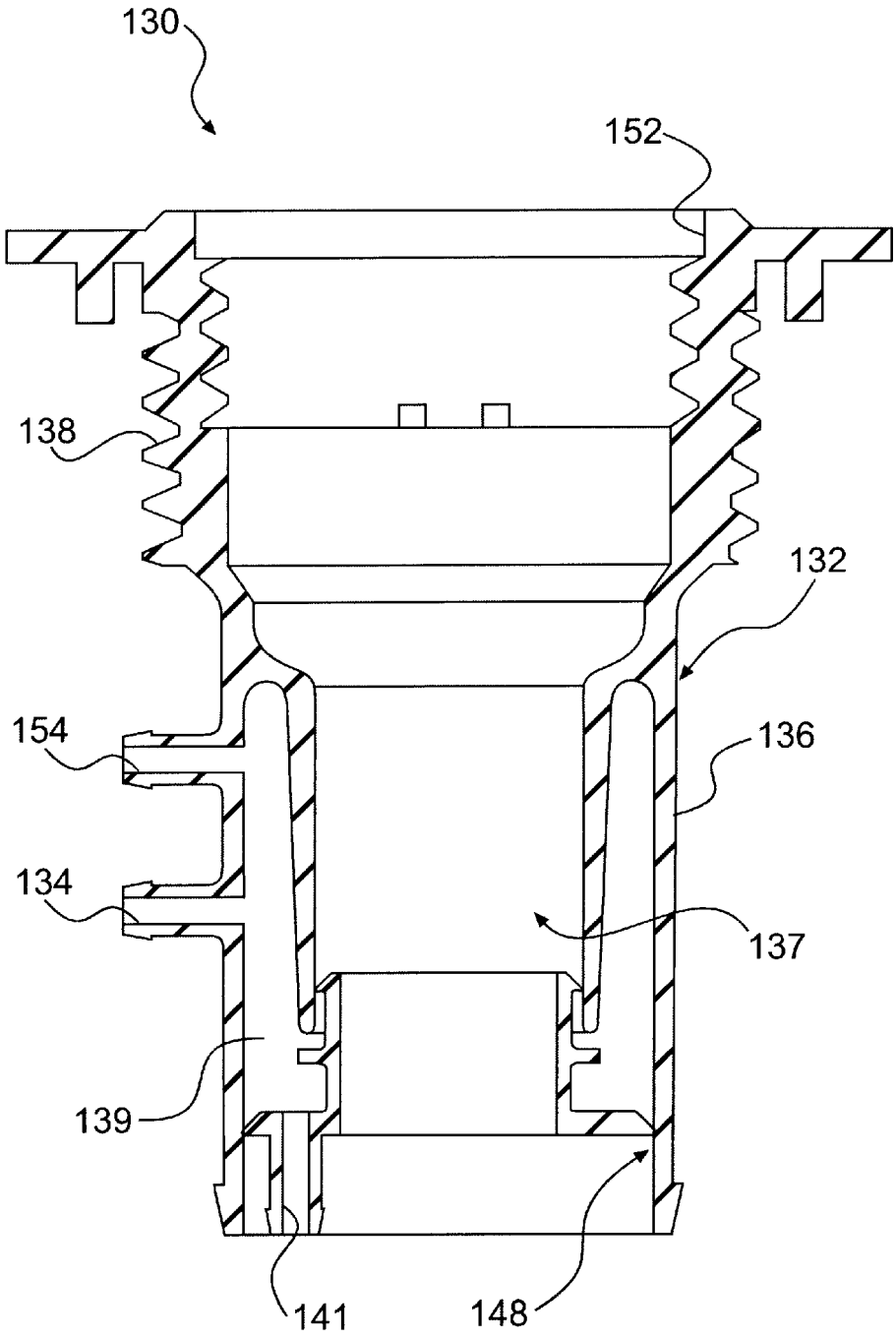
FIG. 11A is a cross sectional view of the oil/air separator taken through the line 11A—11A.

Now, reference is made to FIGS. 10, 11 and 11A, which illustrate the watercraft 10 embodying further principles of the present invention.

The watercraft 10 comprises a forwardly positioned oil reservoir 102, to avoid oil starvation. The oil reservoir 102 is mounted within the cavity formed between the hull 12 and the deck 17. The oil reservoir 102 has a generally hollow configuration and an upwardly facing oil opening 103 therein for a supply of oil to be poured therethrough. The supply of oil is contained in the oil reservoir 102 to be supplied to the engine 14 for lubrication thereof, as is generally known. The oil reservoir 102 may also have an oil level sensor (not shown) mounted thereon, as is generally known. Since, in most circumstances, the oil pump is gravity fed, the lowest portion of the reservoir 102 should be disposed higher than the pump intake.

By engine or engine system is meant the engine 14 and associated lubricated systems. For example, in two stroke engines, the oil pump may also pump a portion of the oil to an air compressor 33 to lubricate the air compressor 33. In four stroke engines, oil may be supplied to a turbocharger or supercharger. It may also be the case that there are crankcase blowby gasses which are forced into the oil. In each of the above described systems, oil having entrained air is returned to the reservoir from the engine system and it is desirable to provide a device for removing the entrained air. Though the present invention is described in terms of a two stroke engine employing an air compressor 33, it may be understood by one skilled in the art that an air compressor 33 per se is not required and any of the above described components may be substituted. Likewise, even if one of the above described components is not present, if there is air entrained in the oil returning to the oil reservoir, an air/oil separator according to the present invention may be provided, with compressors used for suspension systems for example.

An oil supply line, generally indicated at 104, is disposed in communication with the oil reservoir 102 and an oil pump 122, which is preferably mounted to the engine 14, but which could also be remotely mounted. From the oil pump 122, the oil is transmitted to the crankcase 13 of the engine 14 and to the air compressor 33. The oil in the crankcase 13 lubricates the engine 14, while the oil supplied to the air compressor 33 lubricates the air compressor 33. More specifically the piston, crankshaft and connecting rod assembly of the compressor are lubricated.

The air compressor 33 is integrally mounted to the engine 14 and driven by the crankshaft 13 as described in U.S. Pat. No. 6,283,099 (published as International Patent Appln. WO 00/03138 on Jan. 20, 2000) incorporated herein by reference. The air compressor 33 may be of any known construction and need not be integrally mounted to the engine 14 although it is preferred; for example, it may be spaced from the engine 14.

The oil supply line 104 includes an L-shaped connector 106, an oil filter 108 having hose receiving ends 110, 112 and a pair of oil carrying hoses 114, 116. The L-shaped connector 106 is securely mounted to the underside of the oil reservoir 102 by a grommet 118. Positioning the grommet 118 within an opening (not shown) tightly seals this mounting in the underside of the oil reservoir 102 by the force of friction.

The oil carrying hose 114 is connected between a tapered outlet 120 of the L-shaped connector 106 and the hose receiving end 110 of the oil filter 108. The oil carrying hose 116 is connected between the upper hose receiving end 112 of the oil filter 108 and an oil pump 122. The oil pump 122 is disposed in fluid communication with the oil supply line 104 and pumps oil from the oil reservoir 102 to the crankcase 13 of the engine 14 and to the air compressor 33. Preferably, the hoses 114, 116 are secured between the L-shaped connector 106 and the oil filter 108 and between the oil filter 108 and the oil pump 122, respectively, by a plurality of conventional fasteners 45. The fasteners 45 may be of any known construction, such as tie wraps or clamps and may be secured in any known manner.

Some of the pressurized air will bypass or "blow by" the compressor piston and will escape the air compressor 33 along with oil. An oil/air return line 126 communicates between the air compressor 33 and the oil reservoir 102. However, it is preferable that the entrained pressurized air not be returned to the oil reservoir 102 along with the oil, so as not to increase pressures therein.

The oil/air return line 126 includes an oil/air hose 128, which is secured to the lowest portion of the air compressor 33 at one end thereof by one of the conventional fasteners 45, such as a clamp, tie wrap or any other suitable fastening device. The opposite end of the oil/air hose 128 is secured to the oil/air separator 130 by the fasteners 45 so that the oil/air mixture (oil with entrained air) can be supplied to the oil/air separator 130 from the air compressor 33 via the oil/return line 126.

Alternatively, a straight fitting and a shortened hose may be provided between the oil/air hose 128 and the oil/air separator 130 so that the oil/air hose 128 connects to the straight fitting and the shortened hose connects the straight fitting to the oil/air separator. The straight fitting and shortened hose may help to connect the oil/air hose 128 between the oil/air separator 130 and the air compressor 33.

Preferably, the oil/air separator 130 is incorporated in a filler neck 132 as shown, which can be mounted to the deck 17 of the watercraft 10, for example. The filler neck 132 has a substantially tubular configuration. The filler neck 132 has a threaded portion 138 on the upper end thereof for threadedly mounting an oil cap 140 thereon. An annular supporting flange 142 is disposed in surrounding relation to the threaded portion 138 and is configured to support the oil cap 140 thereon. A gasket 144 is disposed within the oil cap 140 and on the flange 142 for providing a tight seal therebetween. An upwardly facing filling opening 152 extends centrally through the threaded portion 138 of the filler neck 132 so as to allow the oil reservoir 102 to be filled therethrough.

A wall portion 136 of the filler neck 132 extends from the threaded portion 138 and is disposed on the lower end of the filler neck 132 to define an outlet port 148 at the lowest end thereof. The filler neck 132 is preferably easily accessible to a user or service person. It may be mounted through a deck opening (not shown) in the exterior of the deck 17 so that the threaded portion 138 is partially disposed outwardly of the deck 17 and the flange 142 engages a marginal area surrounding the deck opening. In one embodiment, the filler neck 132 is located within the deck 17 and accessible via a service panel, for example, in which case the flange 142 may engage a surface of a body component through which the filler neck 132 extends. In an alternate embodiment, the filler neck flange need not extend through any body component, but may be supported by some other component of the vehicle, or may be self-supporting.

An annular sealing gasket 149 and a filler neck nut 151 are fit over the outlet port 148. The filler neck nut 151 has a threaded portion 153 configured to engage the threaded wall portion 138 of the filler neck 132 such that the filler neck nut 151 secures the sealing gasket 149 between the annular supporting flange 142 and the filler neck nut 151 and secures the filler neck 132 within the deck 17.

The outlet port 148 has a frusto-conical configuration, which is best seen in FIGS. 11 and 11A, to receive a filler hose 150 in communication with the oil reservoir 102 so that the separated oil may exit the filler neck 132 through the outlet port 148 and flow into the oil reservoir 102. The wall portion 136 is configured to be secured within the filler hose 150, preferably by snapping therein, but also could be secured therein by the fasteners 45. In the illustrated embodiment, the lower end of the filler hose 150 is connected to the lower end of the wall portion 136 by fastener 45. The lower end of filler hose 150 is connected to the oil reservoir 102 about the opening 103 by one of the fasteners 45 in a known manner.

The wall portion 136 has an inlet port 134 extending outwardly therefrom. The inlet port 134 is disposed in communication with the oil/air return line 126 and the oil/air return line 126 may be connected to the inlet port 134 by one of the fasteners 45, as described above. The inlet port 134 enables a mixture of oil and air from the air compressor 33 to enter the filler neck 132.

An air outlet 154 extends from the wall portion 136 in adjacent spaced relation above the inlet port 134. The air outlet 154 is formed at a higher location than the inlet port 134 so that oil travelling through the inlet port 134 falls downward due to the force of gravity and pressurized air rises up for venting. The air outlet 154 is configured to receive the air hose 158 thereon. The air hose 158 is disposed in fluid communication with the exhaust valve or the air outlet 154 of the oil/air separator 130, and the inlet portion 76 of the air intake adapter 48 so as to conduct the separated air to the container 22. The air hose 158 may be secured to the air outlet 154 by one of the conventional fasteners 45.

Preferably, the air/oil separator 130 is configured to have a pair of coaxial chambers 137, 139 which are not in direct communication with each other. The first chamber 137 communicates directly between the filling opening 152 and the outlet port 148 and into the oil reservoir 102 for enabling oil to be poured into the reservoir 102. The second, outer chamber 139 communicates with the inlet port 134 and the air outlet 154 and further with the oil outlet 141. The oil outlet 141 communicates with the oil reservoir 102 to return the separated oil. Preferably, the oil outlet incorporates a check valve, not shown, which allows the separated oil to flow into the oil reservoir 102, while preventing back flow of oil into the air system, for example when the watercraft is inverted. The air/oil separator could likewise be used in engines having configurations different from those described above. For example, it may be employed in a four stroke engine with a dry sump.

Figure 12:
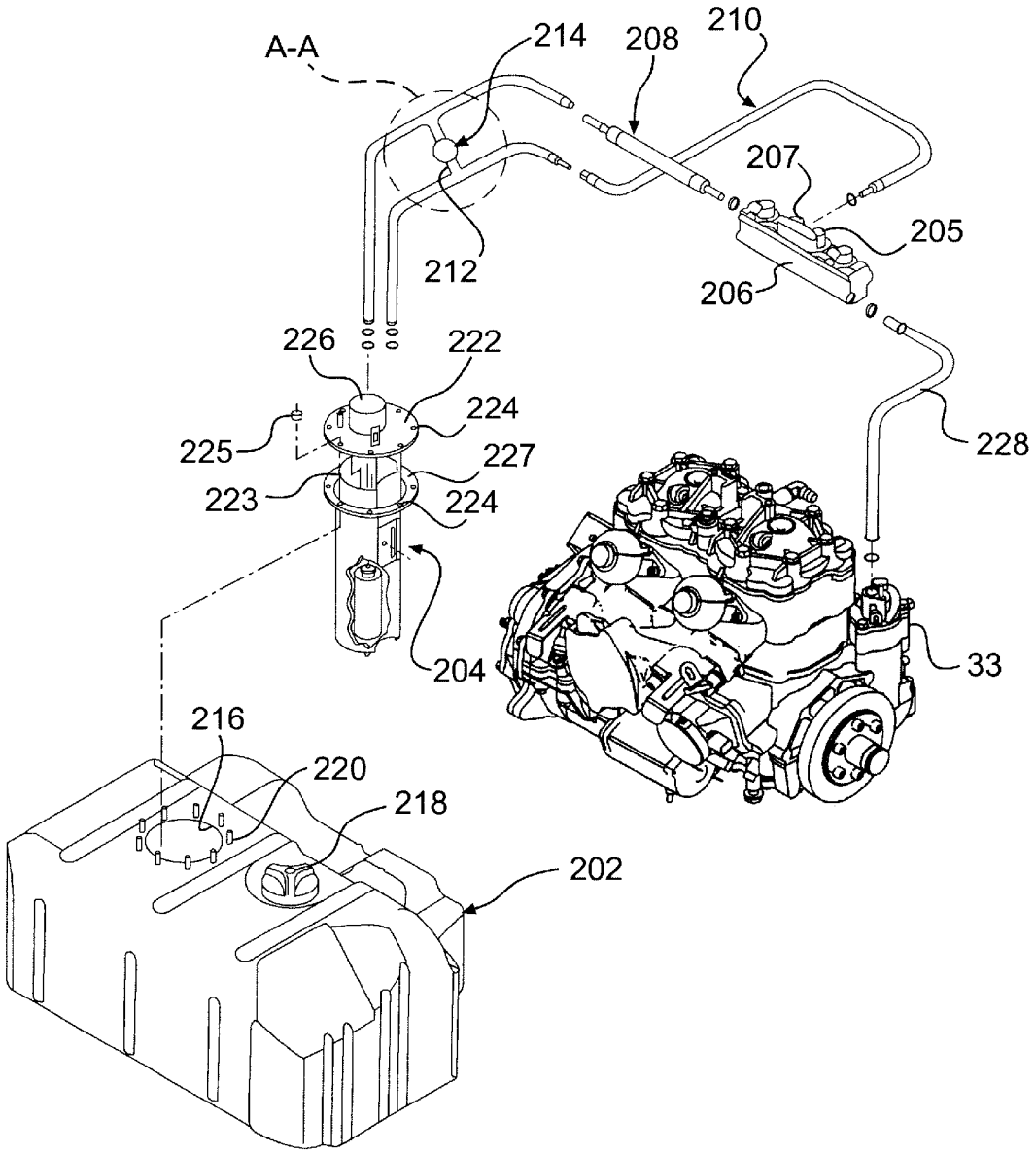
FIG. 12 is a perspective view of a fuel supply and return system constructed in accordance with the principles of the present invention.
Figure 13:
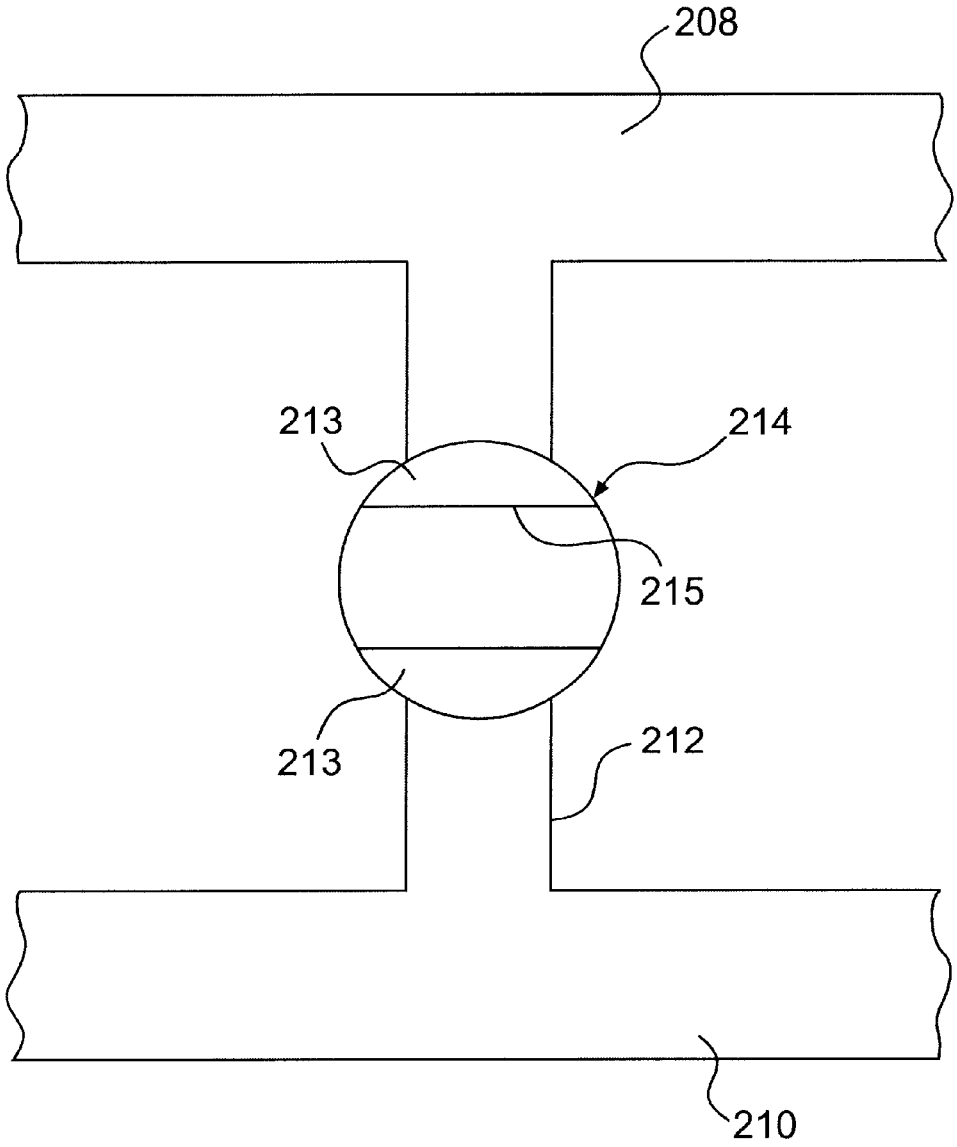
FIG. 13 is a partial enlarged view of the area indicated at A—A in FIG. 12 showing the valve in the closed position thereof.
Figure 14:
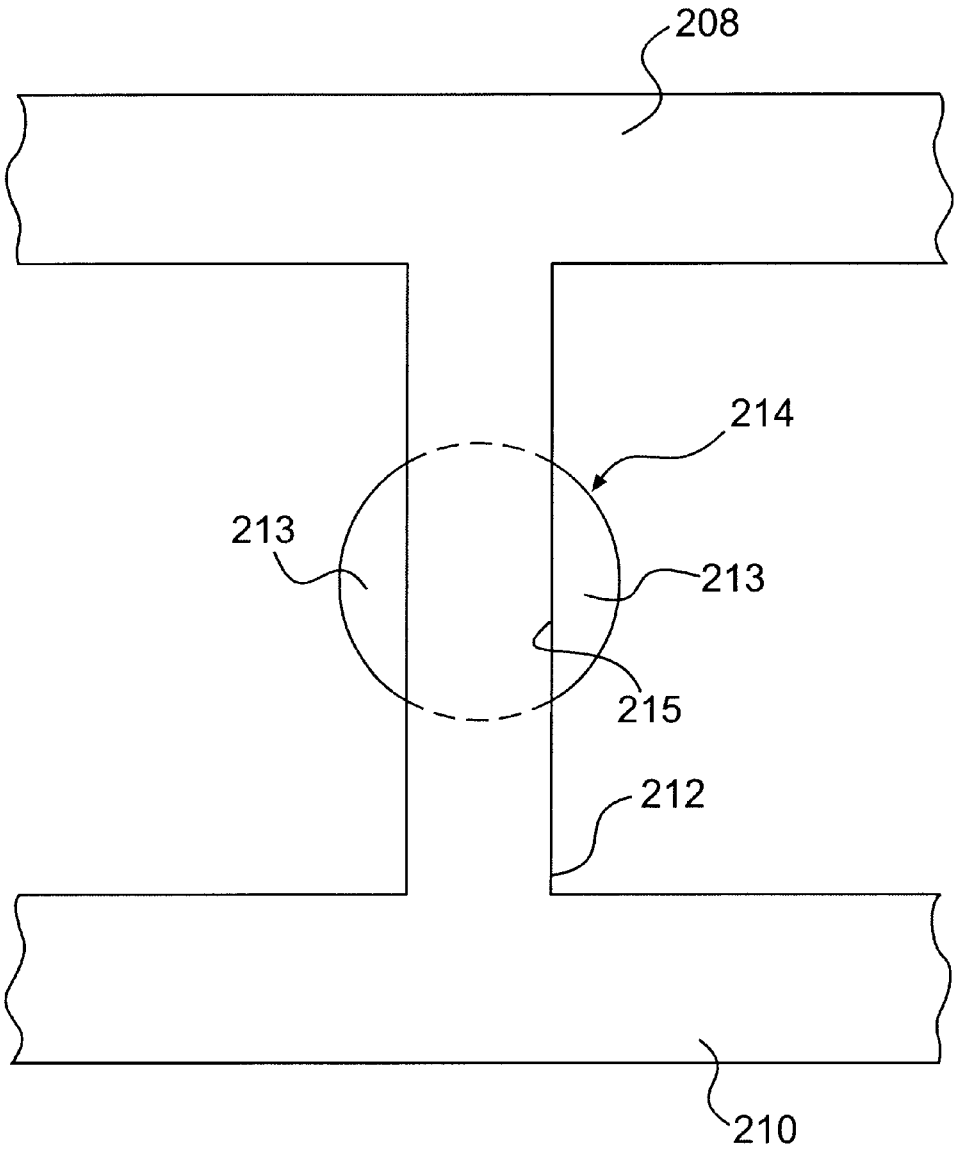
FIG. 14 is a partial enlarged view of the area indicated at A—A in FIG. 12 showing the valve in the open position thereof.

Now, reference is made to FIGS. 12–14, which illustrate the watercraft 10 embodying another aspect of the present invention. In a particular configuration, the watercraft 10 comprises a fuel tank, generally shown at 202 in FIG. 3, wherein the fuel tank 202 includes a fuel pump 204 disposed therein. A fuel regulator 207 attached to a fuel rail 206 is located in spaced relation to the fuel tank 202 and communicated therewith by a fuel supply line 208 and a fuel return line 210. The fuel rail 206 likewise includes an air regulator 205. The fuel supply line 208 supplies fuel to the fuel regulator 206 from the fuel tank 202 while the fuel return line 210 returns excess fuel to the fuel tank 202 from the fuel regulator 206. In conventional configurations, the fuel is regulated at the fuel pump, however, when the fuel pump is located within the fuel tank, the distance between the pump and the regulator reduces the effectiveness of the injectors and produces adverse effects due to pressure loss. Thus, for this configuration, the fuel must be regulated closer to the injectors and preferably within the fuel rail. The result of regulating the fuel within the fuel rail is that there may be excess fuel at the injectors, which should be returned to the fuel reservoir. Thus, the fuel return line 210 becomes necessary, or at least beneficial.

In order to allow release of pressure within the fuel supply line 208, for example, to perform maintenance activities, a fuel bypass is provided. The bypass includes a bypass line 212 disposed between the fuel supply line 208 and the fuel return line 210. The bypass line 212 includes a valve 214 to regulate fuel flow therethrough. As schematically shown in FIGS. 14 and 15, the valve 214 is moveable between a closed position, wherein fuel flow is prevented through the bypass line 212 and an open position. In the open position, fuel is allowed to flow through the bypass line 212. The valve 214 may be of the type shown in the FIGS. 12–14, wherein a portion of the conduit 215 is rotated out of line to close the valve, or it may be of any other suitable type. In one embodiment, the valve 214 includes a pair of annularly spaced fuel blocking portions 213. The fuel blocking portions 213 are disposed on opposite sides of a conduit 215. The conduit 215 allows fuel flow therethrough, until it is moved out of line with the bypass line 212.

The tank 202 is of hollow configuration and has a generally rectangular transverse cross section. The fuel tank 202 has a pair of laterally spaced generally upwardly facing fuel openings disposed in the top portion thereof, one opening 216 of which receives the fuel pump 204. Fuel may be poured through the other fuel opening (not shown) and stored within the tank 202 by a fuel cap 218 mounted to the body of the watercraft and threadedly mounted in sealing relation to the tank 202 to store the fuel within the fuel tank 202. A number of fastening studs 220 extend upwardly from the tank 202 and are disposed in circumferentially spaced relation surrounding the opening 216. In a preferred embodiment, the fuel pump is fixed in its position with studs which are not evenly spaced such that it will fit into the fuel tank in only one orientation.

The pump 204 has a pair of annular mounting flanges 222 exteriorly disposed on an upper portion 223 thereof for mounting the pump 204 within the tank 202. The annular mounting flanges 222 have circumferentially spaced apertures 224 therein to receive the fastening studs 220 extending upwardly from the tank 202. A plurality of nuts 225 threadedly engage the studs 220 to secure the mounting flanges 222 to the tank 202 with the pump 204 disposed therein. The pump 204 can mount within the tank 202 in any known manner and may also be of any construction.

The pump 204 is disposed within the tank 202 to pressurize fuel to be supplied to the fuel rail 204 through the fuel supply line 208. The pump 204 also determines the flow rate of the fuel being carried by the fuel supply line 208.

As best shown in FIG. 13, a fuel filter 226 is disposed between the fuel pump 204 and the fuel supply line 208. Preferably, the fuel filter 226 is integrally formed with the uppermost mounting flange 222 and is configured to have a hose receiving end (not shown) attached thereto such that the fuel filter 226 may connect with the fuel supply line 208.

The fuel regulator 206 regulates fuel flow into any number of fuel injectors (not shown) mounted onto the engine 14. The injectors inject a quantity of fuel from the fuel regulator 206 along with pressurized air from the air compressor 33 into the plurality of cylinders located within the engine 14, wherein a mixture of air and fuel are combusted therein for driving the pistons to effect rotational movement of the crankshaft. The air regulator is connected to the air compressor 33 by a hose 228.

During maintenance of the watercraft 10, a user may manually move the valve 214 from the closed position thereof, wherein fuel flow is prevented through the bypass line 212 to the open position thereof so as to allow fuel to flow through the bypass line 212. Since the fuel in the supply line 208 is prevented from returning to the fuel tank 202 by the pump 204, it must be allowed to return via the return line 210. With the valve in the open position thereof, pressure within the fuel supply line 208 is relieved and the fuel is allowed to flow through the bypass line 212. The fuel pressures in the fuel supply line 208 and the fuel return line 210 equalize, and fuel is allowed to drain from that portion of the fuel return line 210 into the fuel tank 202, where it may be recycled for future use. After maintenance is finished, pressure is restored within the fuel supply line 208 by moving the valve to the closed position and inserting the key into the ignition and running the fuel pump 204.

Rather than providing a bypass line, per se, the return valve may be a part of a single fitting, for example, an H-shaped fitting, which interconnects the fuel line and the return line. In such a configuration, not shown, the central portion of the H contains the valve and forms the bypass line, which may be little more than the valve and its connections to the fuel and return lines.

In another alternate configuration, not shown, for example in the case that there is no fuel return line, or that communication between the fuel supply and return line may not be desired, the fuel may be returned directly back to the fuel tank 202 rather than to a fuel return line. For example, in one such configuration, a branch of the fuel line leads directly back to the fuel tank 202 and is closed with a valve in normal operation. When the fuel line needs to be cleared, the valve is released, allowing the fuel to bypass the pump and to be deposited directly into the fuel tank. A second, similar variation may be employed where the fuel pump is remote from the outlet of the fuel tank. In this case, the fuel line extends from the pump and to or through an opening in the fuel tank. The portion of the fuel line within the tank contains a branch with a valve that is closed in normal operation. To clear the fuel line, the valve is opened, allowing the fuel to bypass the pump and enter the fuel tank. In this configuration, the valve may be remotely controlled in order to release it without opening the fuel tank.

In addition to uses in fuel systems, the relief valve could be employed in such systems as closed-loop cooling systems, to release pressure to an expansion tank, which likewise encounter problems with pressure relief for maintenance activities.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

We claim:

1. A watercraft, comprising:

a hull having an interior compartment and an exterior;

an engine mounted within the interior compartment of the hull;

a propulsion system operatively coupled to the engine;

an air/water separator disposed within the interior compartment of the hull and being moveable between an installed position and an uninstalled position, the air/water separator comprising a container enclosing an interior space, an inlet enabling air to enter the container, an outlet enabling air to leave the container; and an air intake conduit disposed within the interior compartment of the hull and having a first end connected to the engine for supplying air to the engine and a second end connected to the outlet of the air/water separator, the second end of the conduit being mounted in a sealed relationship to the outlet by a cooperative fit which occurs upon movement of said air/water separator into the installed position, the air/water separator being mounted to the engine solely by the cooperative fit.

2. A watercraft according to claim 1, wherein said cooperation engagement which occurs upon movement of said air/water separator is between said second end of said air intake conduit and said outlet.

3. A watercraft as in claim 2, wherein the cooperative engagement is a friction fit and the force of friction is produced by elastic deformation of one of the first end of the air intake conduit and the perimeter of the outlet.

4. A watercraft as in claim 1, wherein the inlet is one of an inlet port and an inlet projecting portion.

5. A watercraft according to claim 1, wherein the outlet of the air/water separator is an outlet port, and the second end of the air intake conduit is disposed within the outlet port.

6. A watercraft as in claim 5, wherein a structure is constructed and arranged to define the outlet in the container that enables ambient air to exit the container and is constructed and arranged to define another inlet in the container to be in fluid communication with a lubrication system of the watercraft.

7. A watercraft as in claim 6, wherein the engine includes an air compressor, the air compressor being in communication with the outlet so that the outlet provides air from said air/water separator to the air compressor for use in the engine.

8. A watercraft as in claim 7, wherein the compressor is integrally mounted to the engine.

9. A watercraft as in claim 1, wherein a portion of the conduit is mounted to a throttle body of the internal combustion engine.

10. A watercraft as in claim 1, wherein the watercraft is a personal watercraft, the personal watercraft comprising:

a deck having a lower portion positioned on an upper portion of the hull;

a straddle seat portion positioned on the deck, the seat being configured to receive and support one or more riders;

a steering assembly positioned on the deck and forward of the straddle seat portion, wherein the propulsion system is a jet propulsion system that includes a nozzle configured to direct a water stream in a direction to propel the watercraft along the surface of the body of water, the steering assembly being operatively engaged with the jet propulsion system such that movement of the steering assembly effects movement of the nozzle to change the direction of the water stream.

11. A method for mounting an air/water separator in a watercraft, the watercraft comprising a hull having an interior compartment and an exterior, an engine mounted within the interior compartment of the hull, a propulsion system operatively coupled to the engine, and an air intake conduit having a first end connected to the engine and a second end, said method comprising:

providing an air/water separator in the interior compartment of the hull comprising a container enclosing an interior space, an inlet enabling air to enter the container, and an outlet enabling air to leave the container; and moving the air/water separator into an installed position adjacent the air intake conduit such that the second end of the air intake conduit is mounted in a sealed relationship to the outlet by a cooperative fit between the second end of the conduit and the outlet, such that the air/water separator is mounted to the engine solely by the cooperative fit.

12. A method according to claim 11, wherein the outlet of the air/water separator is an outlet port, and the second end of the air intake conduit is received within the outlet port.

13. A method as in claim 11, wherein the watercraft is a personal watercraft, the personal watercraft comprising:

a deck having a lower portion positioned on an upper portion of the hull;

a straddle seat portion positioned on the deck, the seat being configured to receive and support one or more riders;

a steering assembly positioned on the deck and forward of the straddle seat portion, wherein the propulsion system is a jet propulsion system that includes a nozzle configured to direct a water stream in a direction to propel the watercraft along the surface of the body of water, the steering assembly being operatively engaged with the jet propulsion system such that movement of the steering assembly effects movement of the nozzle to change the direction of the water stream.

* * * * *